US010017986B2

(12) United States Patent
Brondex

(10) Patent No.: US 10,017,986 B2
(45) Date of Patent: Jul. 10, 2018

(54) WINDING DEVICE FOR A WINDABLE SCREEN AND CLOSURE OR SUN-PROTECTION HOME-AUTOMATION INSTALLATION INCLUDING SUCH A DEVICE

(71) Applicant: SOMFY SAS, Cluses (FR)

(72) Inventor: Adrien Brondex, Domancy (FR)

(73) Assignee: SOMFY SAS, Cluses (FR)

( * ) Notice: Subject to any disclaimer, the term of this patent is extended or adjusted under 35 U.S.C. 154(b) by 0 days.

(21) Appl. No.: 15/189,100

(22) Filed: Jun. 22, 2016

(65) Prior Publication Data

US 2016/0376842 A1 Dec. 29, 2016

(30) Foreign Application Priority Data

Jun. 24, 2015 (FR) ..... 15 55795

(51) Int. Cl.
*A47G 5/02* (2006.01)
*A47H 1/00* (2006.01)
(Continued)

(52) U.S. Cl.
CPC ..... *E06B 9/68* (2013.01); *E06B 9/174* (2013.01); *E06B 9/40* (2013.01); *E06B 9/72* (2013.01);
(Continued)

(58) Field of Classification Search
CPC ..... E06B 2009/6881; E06B 9/40; E06B 9/50; E06B 9/174; E06B 9/68; E06B 9/72; E06B 9/80; E06B 2009/6809
See application file for complete search history.

(56) References Cited

U.S. PATENT DOCUMENTS

2010/0078137 A1* 4/2010 Angelini ..... E06B 9/88 160/311
2010/0320855 A1* 12/2010 Lagarde ..... E06B 9/72 310/77

(Continued)

FOREIGN PATENT DOCUMENTS

FR 2 995 001 A1 3/2014

OTHER PUBLICATIONS

FR Search Report, dated Apr. 25, 2016, from corresponding FR application.

*Primary Examiner* — Katherine W Mitchell
*Assistant Examiner* — Jeremy C Ramsey
(74) *Attorney, Agent, or Firm* — Young & Thompson

(57) ABSTRACT

A winding device for a windable screen of a closure or sun-protection home-automation installation, includes: a winding tube movable around a rotation axis; a hollow sleeve positioned at one of the two ends and inside the winding tube; a tubular electromechanical actuator inserted inside the hollow sleeve; and two supports, each support being positioned across from one of two ends of the winding tube. The tubular electromechanical actuator includes: a case, and a closing off element positioned at one end of the case. The closing off element has a front face positioned in a plane parallel to a wall of one of the two supports, and includes first fastening elements cooperating with second fastening elements of the support. The hollow sleeve includes a first stop cooperating with a stop of the closing off element, and a second stop cooperating with the end of the winding where the sleeve is inserted.

8 Claims, 6 Drawing Sheets

(51) Int. Cl.

| | |
|---|---|
| ***E06B 9/68*** | (2006.01) |
| ***E06B 9/174*** | (2006.01) |
| ***E06B 9/72*** | (2006.01) |
| ***E06B 9/40*** | (2006.01) |
| ***E06B 9/80*** | (2006.01) |

(52) U.S. Cl.
CPC ..... *E06B 9/80* (2013.01); *E06B 2009/6809* (2013.01)

(56) References Cited

U.S. PATENT DOCUMENTS

| | | | | |
|---|---|---|---|---|
| 2013/0000091 | A1* | 1/2013 | Wills | E06B 9/44<br>29/282 |
| 2013/0126107 | A1* | 5/2013 | Feldstein | E06B 9/72<br>160/310 |
| 2013/0220560 | A1* | 8/2013 | Mullet | E06B 9/74<br>160/291 |

* cited by examiner

WINDING DEVICE FOR A WINDABLE SCREEN AND CLOSURE OR SUN-PROTECTION HOME-AUTOMATION INSTALLATION INCLUDING SUCH A DEVICE

FIELD OF THE INVENTION

The present invention relates to a winding device for a windable screen of a closure or sun-protection home-automation installation.

The present invention also relates to a closure or sun-protection home-automation installation comprising a windable screen, using such a winding device, able to be wound on a tube rotated by a tubular electromechanical actuator.

In general, the present invention relates to the field of concealment devices comprising a motorized driving device setting a screen in motion between at least one first position and one second position.

BACKGROUND OF THE INVENTION

A motorized driving device comprises an electromechanical actuator for a movable element for closing, concealing or providing sun protection such as a blind, shutter, door, gate, or any other equivalent material, hereinafter referred to as a screen.

Winding devices are known for a windable screen of a closure or sun-protection home-automation installation. These winding devices comprise a winding tube, a hollow sleeve, a tubular electromechanical actuator and two supports. Each support is positioned opposite one end of the winding tube. The hollow sleeve is an assembly accessory for assembling the tubular electromechanical actuator in the winding tube.

The tubular electromechanical actuator is inserted inside the hollow sleeve. The hollow sleeve is positioned at one of the ends of the winding tube and inside the winding tube.

The tubular electromechanical actuator comprises a case and an element for closing off the case. The closing off element is positioned at one end of the case of the tubular electromechanical actuator. The closing off element comprises a front face positioned in a plane parallel to a wall of one of the two supports, in the assembled configuration. The closing off element of the tubular electromechanical actuator comprises fastening elements cooperating with said support.

The hollow sleeve comprises a first stop cooperating with a stop of the closing off element of the tubular electromechanical actuator, so as to block the translation of the hollow sleeve relative to the closing off element of the tubular electromechanical actuator, and a second stop cooperating with the end of the winding tube through which the hollow sleeve is inserted in the winding tube, in an insertion direction of the hollow sleeve inside the winding tube, so as to block the translation of the hollow sleeve relative to the end of the winding tube. The first and second stops of the hollow sleeve are formed by walls of the hollow sleeve.

However, these winding devices have the drawback of generating a separation between a support of the winding device and an end of a winding tube through which the tubular electromechanical actuator is inserted, depending on the distance between the stop of the closing off element of the tubular electromechanical actuator cooperating with the first stop of the hollow sleeve and the fastening elements of the closing off element of the tubular electromechanical actuator cooperating with the support.

The second stop of the hollow sleeve is further from the support on which the closing off element of the tubular electromechanical actuator is fastened relative to the first stop of the hollow sleeve, in the direction of the rotation axis of the hollow sleeve, which is combined with the rotation axis in the assembled configuration of the winding device.

Thus, the positioning of the end of the winding tube through which the tubular electromechanical actuator is inserted is determined by the cooperation of the first stop of the hollow sleeve with the stop of the closing off element of the tubular electromechanical actuator and by the cooperation of this end of the winding tube with the second stop of the hollow sleeve.

Consequently, the separation between the support of the winding device and the end of the winding tube through which the tubular electromechanical actuator is inserted creates a separation between a lateral edge of the screen and the support of the winding device, since the screen has a width equivalent to the width of the winding tube and since the screen is centered along the width of the winding tube.

In this way, the separation between the lateral edge of the screen and the support of the winding device is fixed and depends on the assembly of the winding device.

Such winding devices create zones not concealed by the screen between the winding tube and the two supports, which may generate visual discomfort for users.

SUMMARY OF THE INVENTION

The present invention aims to resolve the aforementioned drawbacks and propose a winding device for a windable screen of a closure or sun-protection home-automation installation making it possible to reduce the distance between a support of the winding device and an end of the winding tube through which the tubular electromechanical actuator is inserted and thus to minimize the space between at least one lateral edge of a screen and a support of the winding device.

In this respect, according to a first aspect, the present invention targets a winding device for a windable screen of a closure or sun-protection home-automation installation, the winding device comprising:

- a winding tube movable around a rotation axis,
- a hollow sleeve,
- a tubular electromechanical actuator, and
- two supports, each support being positioned across from one end of the winding tube,
  - the tubular electromechanical actuator being inserted inside the hollow sleeve,
  - the hollow sleeve being positioned at one of the ends of the winding tube and inside the winding tube,
- the tubular electromechanical actuator comprising:
- a case, and
- a closing off element, the closing off element being positioned at one end of the case of the tubular electromechanical actuator, the closing off element comprising a front face positioned in a plane parallel to a wall of one of the two supports, the closing off element of the tubular electromechanical actuator comprising fastening elements cooperating with fastening elements of said support,
- the hollow sleeve comprising:
- a first stop cooperating with a stop of the closing off element of the tubular electromechanical element, so as to block the translation of the hollow sleeve relative to the closing off element of the tubular electromechanical actuator, and a second stop cooperating with the end of the winding tube through which the hollow sleeve is inserted in the winding tube, in an insertion direction of the hollow sleeve inside the winding tube, so as to block the translation of the hollow tube relative to the end of the winding tube.

According to the invention, the hollow sleeve and the winding tube at least partially cover the closing off element of the tubular electromechanical actuator, over an axial range extending between the stop of the closing off element of the tubular electromechanical actuator and the front face of the closing off element.

Thus, the at least partial covering of the closing off element of the tubular electromechanical actuator by the hollow sleeve and the winding tube over the axial range, between the stop of the closing off element of the tubular electromechanical actuator and the front face of the closing off element, makes it possible to reduce the axial distance between the support of the winding device on which the closing off element of the tubular electromechanical actuator is fixed and the end of the winding tube through which the tubular electromechanical actuator is inserted.

In this way, the second stop of the hollow sleeve and the end of the winding tube through which the tubular electromechanical actuator is inserted protrude past the stop of the closing off element of the tubular electromechanical actuator, in the direction of the rotation axis of the winding tube.

Within the meaning of the present invention, a dimension or direction is "axial" when it is parallel to the rotation axis of the winding tube in the mounted configuration of the winding device.

The second stop of the hollow sleeve cooperating with the end of the winding tube, through which the hollow sleeve is inserted in the winding tube, is closer than in the known materials to the support on which the closing off element of the tubular electromechanical actuator is fixed relative to the first stop of the hollow sleeve cooperating with the stop of the closing off element of the tubular electromechanical actuator, in the direction of the rotation axis of the hollow sleeve, which is combined, in the assembled configuration, with the rotation axis of the winding tube.

Furthermore, the space between at least one lateral edge of the screen and the adjacent support of the winding device is minimized.

Moreover, the determination of the axial length between the first and second stops of the hollow sleeve makes it possible to adjust the positioning of the end of the winding tube through which the hollow sleeve is inserted in the winding tube relative to the front face of the closing off element of the tubular electromechanical actuator, along the rotation axis of the winding tube around the tubular electromechanical actuator.

According to one preferred feature of the invention, the winding device also comprises a ring positioned between the tubular electromechanical actuator and the hollow sleeve, the tubular electromechanical actuator also being inserted inside the ring.

In one embodiment, the ring comprises, on its inner face, a gear in the form of a crown cooperating with a pinion of a metering mechanism installed inside the case of the tubular electromechanical actuator.

In another embodiment, the ring is smooth and forms a bearing.

In one case, the hollow sleeve comprises adjusting elements, so as to adjust the axial length between the first and second stops of the hollow sleeve and adjust the positioning of the end of the winding tube, through which the hollow sleeve is inserted in the winding tube, relative to the front face of the closing off element of the tubular electromechanical actuator, along a rotation axis of the winding tube around the tubular electromechanical actuator.

In one example embodiment, the adjusting elements of the hollow sleeve are sectile elements.

In another case, the winding device comprises adjusting elements, so as to adjust the positioning of the end of the winding tube, through which the hollow sleeve is inserted in the winding tube, relative to the front face of the closing off element of the tubular electromechanical actuator, along a rotation axis of the winding tube around the tubular electromechanical actuator.

In practice, the adjusting elements of the winding device are positioned between the first stop of the hollow sleeve and the stop of the closing off element of the tubular electromechanical actuator.

Advantageously, the closing off element of the tubular electromechanical actuator is a revolving part, in particular with a circular section.

According to another preferred feature of the invention, the outer diameter of the part of the closing off element of the tubular electromechanical actuator situated outside the case of the tubular electromechanical actuator, in the assembled configuration of the tubular electromechanical actuator, is greater than or equal to the outer diameter of the case of the tubular electromechanical actuator.

According to a second aspect, the present invention targets a closure or sun-protection home-automation installation comprising a screen that is windable using a winding device according to the invention on a winding tube rotated by a tubular electromechanical actuator.

This home automation installation has features and advantages similar to those previously described relative to the winding device described above.

Other particularities and advantages of the invention will also appear in the description below.

BRIEF DESCRIPTION OF THE DRAWING

In the appended drawings, provided as non-limiting examples.

DETAILED DESCRIPTION OF THE INVENTION

Figure 1:
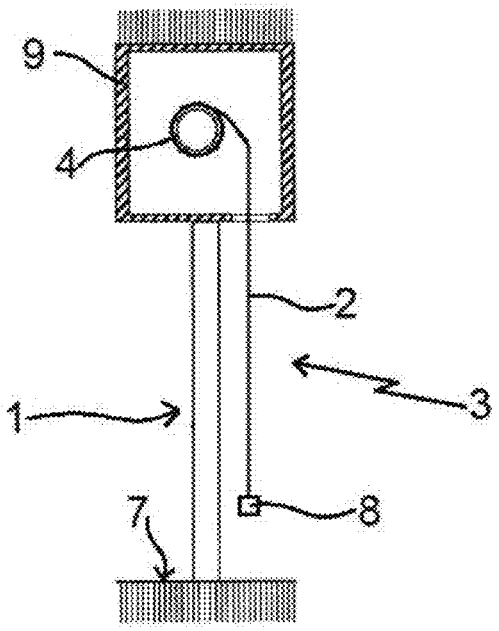
FIG. 1 is a cross-sectional diagrammatic view of a home automation installation according to one embodiment of the invention.
Figure 2:
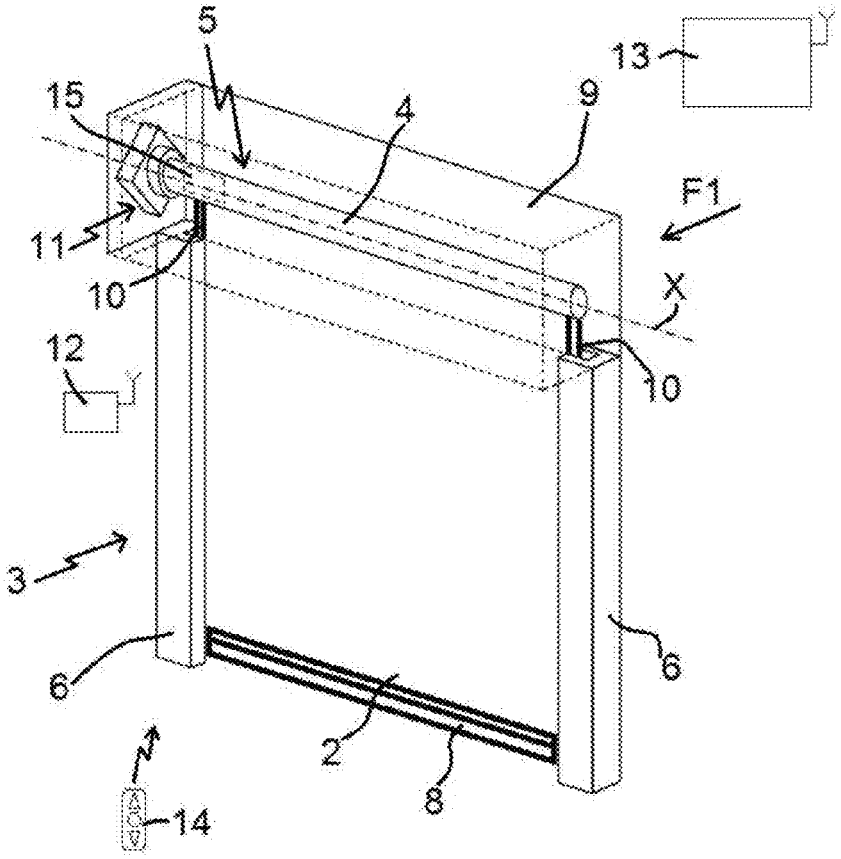
FIG. 2 is a diagrammatic perspective view of the home automation installation illustrated in FIG. 1.

In reference to FIGS. 1 and 2, we will first describe a home automation installation according to the invention and installed in a building comprising an opening 1, window or door, equipped with a screen 2 belonging to a concealing device 3, in particular a motorized windable blind.

The concealing device 3 can be a canvas blind, a rolling shutter with or without orientable slats, or a rolling gate. The present invention applies to all types of concealing devices.

A windable blind according to one embodiment of the invention will be described in reference to FIGS. 1 and 2.

The screen 2 of the concealing device 3 is wound on a winding tube 4 driven by a motorized driving device 5 and movable between a wound position, in particular an upper position, and an unwound position, in particular a lower position.

The moving screen 2 of the concealing device 3 is a closing, concealing and/or sun protection screen, winding on the winding tube 4, the inner diameter of which is generally substantially greater than the outer diameter of an electromechanical actuator 11, such that the electromechanical actuator 11 can be inserted into the winding tube 4 during the assembly of the concealing device 3.

The motorized driving device 5 comprises the electromechanical actuator 11, in particular of the tubular type, making it possible to set the winding tube 4 in rotation so as to unwind or wind the screen 2 of the concealing device 3.

The concealing device 3 comprises the winding tube 4 for winding the screen 2, where, in the mounted state, the electromechanical actuator 11 is inserted into the winding tube 4.

The concealing device 3 also comprises a load bar 8 for exerting tension on the screen 2.

In a known manner, the windable blind, which forms the concealing device 3, includes a canvas, forming the screen 2 of the windable blind 3. A first end of the screen 2, in particular the upper end of the screen 2 in the assembled configuration of the concealing device 3 in the home-automation installation, is fastened to the winding tube 4. Additionally, a second end of the screen 2, in particular the lower end of the screen 2 in the assembled configuration of the concealing device 3 in the home-automation installation, is fastened to the load bar 8.

Here, the canvas forming the screen 2 is made from a textile material. Furthermore, such a canvas forming the screen 2 can be provided to be impermeable to air, in other words wind-resistant.

In an example embodiment that is not shown, the first end of the screen 2 has an eyelet through which a rod is positioned, in particular made from plastic. This eyelet made at the first end of the screen 2 is obtained using a seam of the canvas forming the screen 2. During the assembly of the screen 2 on the winding tube 4, the eyelet and the rod situated at the first end of the screen 2 are inserted by sliding in a slot arranged on the outer face of the winding tube 4, in particular over the entire length of the winding tube 4, so as to be able to wind and unwind the screen 2 around the winding tube 4.

In the case of a windable blind, the upper wound position corresponds to the setting of the load bar 8 of the screen 2 against an edge of a box 9 of the windable blind 3, and the lower unwound position corresponds to the setting of the load bar 8 of the screen 2 against a threshold 7 of the opening 1.

The winding tube 4 is positioned inside the box 9 of the windable blind 3. The screen 2 of the windable blind 3 winds and unwinds around the rolling tube 4 and is housed at least partially inside the box 9.

In general, the box 9 is positioned above the opening 1, or in the upper part of the opening 1.

In one embodiment, as illustrated in FIG. 2, the screen 2 also includes, at each of its lateral edges, a fastening part 10 in the form of a strip. The fastening parts 10 form an overthickness at each lateral edge of the screen 2. The home-automation installation comprises two lateral guideways 6 positioned along two lateral edges of the opening 1. The lateral guideways 6 additionally respectively comprise a groove inside which a fastening part 10 of the screen 2 is retained, as well as a lateral end of the load bar 8 fastened to the second end of the screen 2.

Thus, during the winding or unwinding of the screen 2, the fastening parts 10 fastened on the lateral edges of the screen 2 and the lateral ends of the load bar 8 fastened to the second end of the screen 2 are retained in the lateral guideways 6, so as to guarantee lateral guidance of the screen 2.

Each groove arranged in a lateral guideway 6 makes it possible to prevent the withdrawal of a fastening part 10 fixed on one of the lateral edges of the screen 2, during the movement of the screen 2 between the wound position and the unwound position.

Preferably, each fastening part 10 extends along the entire length of one of the two lateral edges of the screen 2.

In one example embodiment, the fastening parts 10 are respectively fastened at a lateral edge of the screen 2 by gluing, welding or overmolding. Additionally, the fastening parts 10 can be made from plastic, and in particular, overmolded on the lateral edges of the screen 2.

Here, the lateral guideways 6 respectively positioned along a lateral edge of the opening 1 extend along a vertical direction. The lateral guideways 6 extend from the threshold 7 of the opening 1 to the box 9 of the windable blind 3.

Advantageously, trim elements, not shown, are positioned inside lateral guideways 6 and cooperate with the fastening parts 10 respectively fastened at a lateral edge of the screen 2, so as to keep the screen 2 stretched by applying a force on each fastening part 10 against a wall of the lateral guideway 6.

For example and non-limitingly, the trim elements positioned inside the lateral guideways 6 are provided with elastics, in particular made from plastic. The trim element can also be provided in the form of foam or include a fly.

Thus, the trim elements positioned inside the lateral guideways 6 make it possible to guarantee the application of a frictional resistance on the fastening parts 10 of the screen 2, so as to keep the screen 2 stretched, during a movement of the screen 2 or when the screen 2 is kept stopped.

Advantageously, the box 9 of the windable blind 3 and the lateral guideways 6 form a frame inside which the screen 2 can be moved. This frame can be closed by an additional bar connecting the two lateral guideways 6 at the threshold 7 of the opening 1.

The motorized driving device 5 is controlled by a control unit. The control unit may for example be a local control unit 12, where the local control unit 12 can be connected through a wired or wireless connection with a central control unit 13. The central control unit 13 drives the local control unit 12, as well as other similar local control units distributed throughout the building.

The central control unit 13 can be in communication with a weather station located outside the building, in particular including one or more sensors that can be configured for example to determine the temperature, brightness, or wind speed.

A remote control 14, which can be a type of local control unit, and provided with a control keypad, which comprises selection and display means, further allows a user to intervene on the electromechanical actuator 11 and/or the central control unit 13.

The motorized driving device 5 is preferably configured to carry out the unwinding or winding commands of the screen 2 of the concealing device 3, which may in particular be acquired by the remote control 14.

The electromechanical actuator 11 comprises an electric motor 16. The electric motor 16 comprises a rotor and a stator, not shown and positioned coaxially around a rotation axis X, which is also the rotation axis of the winding tube 4 in the assembled configuration of the motorized driving device 5.

Control means for controlling the electromechanical actuator 11, making it possible to move the screen 2 of the concealing device 3, comprise at least one electronic control unit 15. This electronic control unit 15 is able to operate the electric motor 16 of the electromechanical actuator 11, and in particular to allow the supply of electricity for the electric motor 16.

Thus, the electronic control unit 15 in particular controls the electric motor 16, so as to open or close the screen 2, as previously described.

The electronic control unit 15 also comprises an order receiving module, in particular for wireless orders sent by an order transmitter such as the remote control 14 designed to control the electromechanical actuator 11 or one of the local 12 or central 13 control units.

The order receiving module can also allow the reception of orders sent by wired means.

Figure 3:
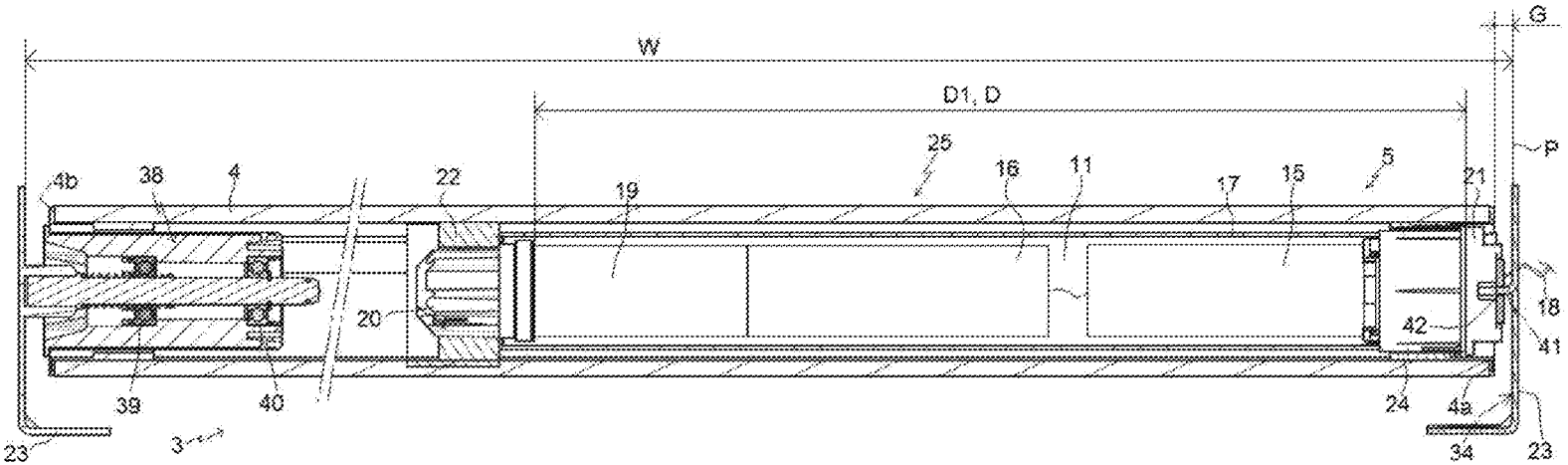
FIG. 3 is a partial diagrammatic axial sectional view of the home automation installation illustrated in FIGS. 1 and 2 comprising a winding device according to one embodiment of the invention.

Here, and as illustrated in FIG. 3, the electronic control unit 15 is positioned inside a casing 17 of the electromechanical actuator 11.

The control means of the electromechanical actuator 11 comprise hardware and/or software means.

As one non-limiting example, the hardware means may comprise at least one microcontroller.

Figure 4:
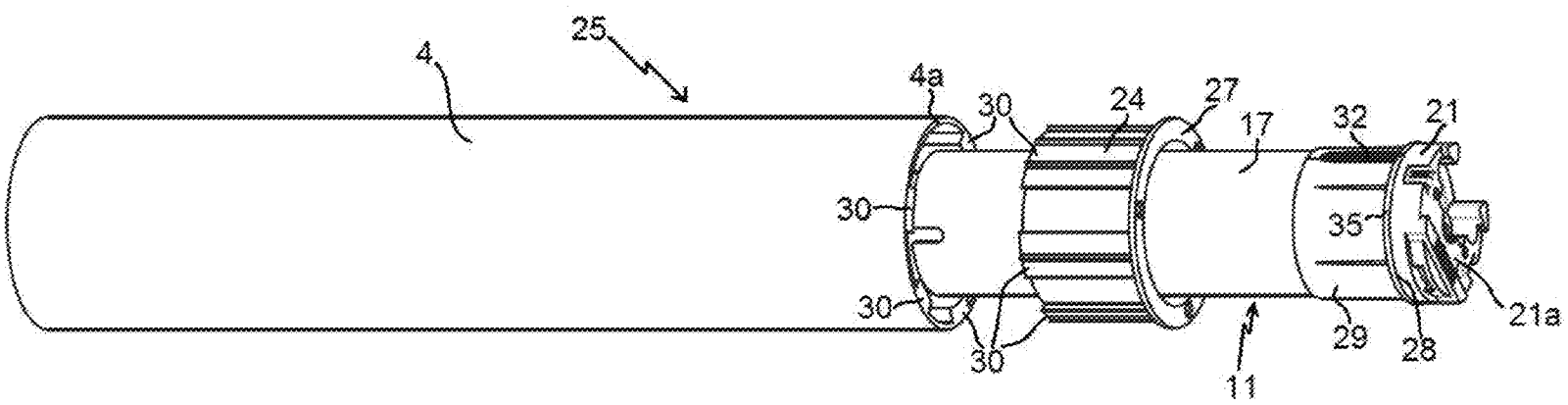
FIG. 4 is a partial exploded view of the winding device illustrated in FIG. 3.
Figure 5:
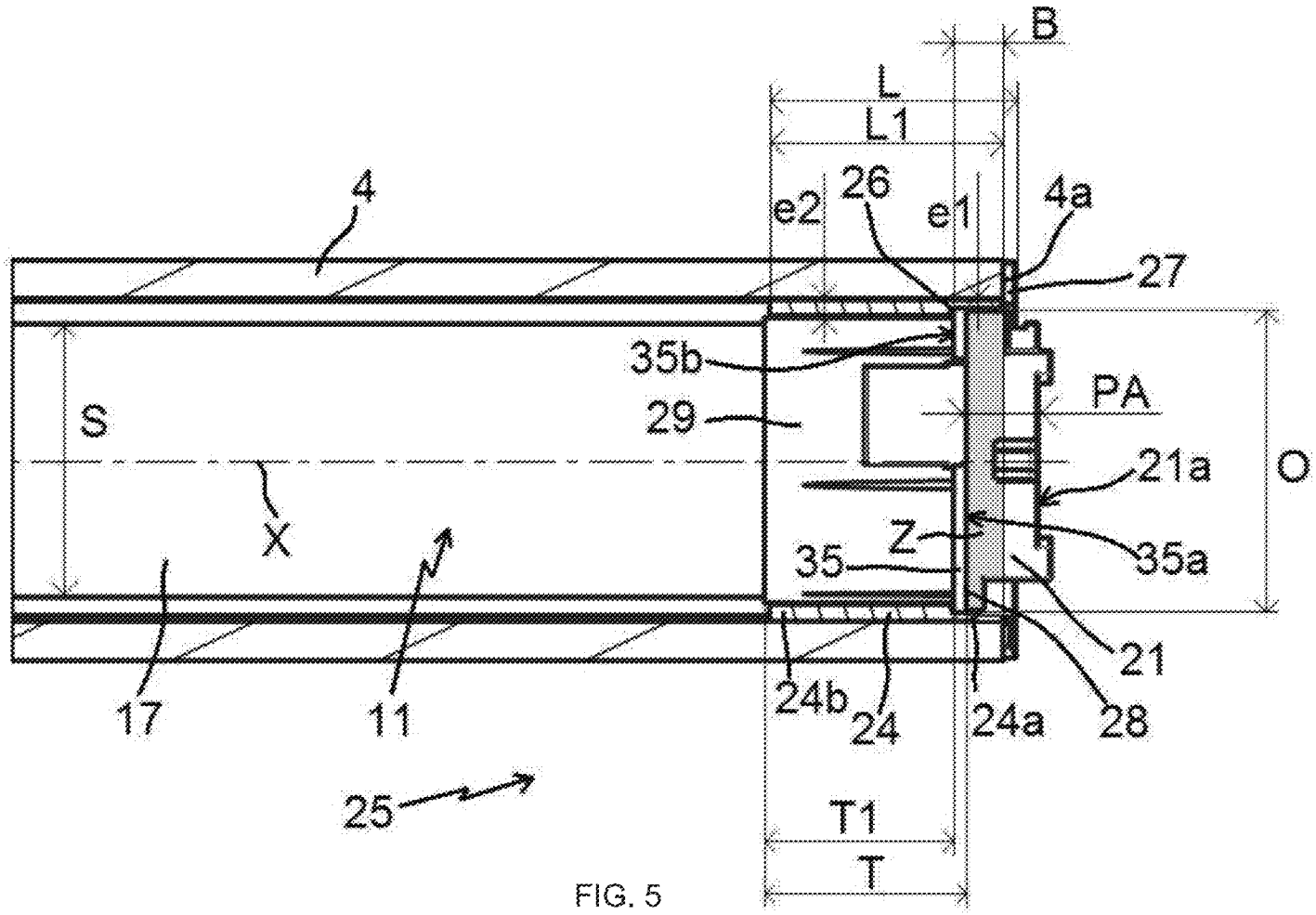
FIG. 5 is a diagrammatic partial axial sectional view of the winding device illustrated in FIG. 4.

A winding device 25 according to one embodiment of the invention and belonging to the home-automation installation of FIGS. 1 and 2 will now be described in reference to FIGS. 3 to 7. In FIGS. 3 to 5, the winding device 25 is seen in the direction of arrow F1 in FIG. 2.

The electromechanical actuator 11 is supplied with electricity by an electricity grid of the sector, or using a battery, which can for example be recharged by a photovoltaic panel. The electromechanical actuator 11 makes it possible to move the screen 2 of the concealing device 3.

Here, the electromechanical actuator 11 comprises a power cable 18 making it possible to supply electricity from the electricity grid of the sector.

The case 17 of the electromechanical actuator 11 is preferably cylindrical.

In one embodiment, the case 17 is made from a metal material. The material of the electromechanical actuator is in no way limiting and may be different, and in particular made from plastic.

The electromechanical actuator 11 also comprises a reducing gear device 19 and an output shaft 20.

Advantageously, the electric motor 16 and the reducing gear device 19 are positioned inside the case 17 of the electromechanical actuator 11.

The output shaft 20 of the electromechanical actuator 11 is positioned inside the winding tube 4, and at least partially outside the case 17 of the electromechanical actuator 11.

The output shaft 20 of the electromechanical actuator 11 is coupled by a connecting means 22 to the winding tube 4, in particular using a wheel-shaped connecting means.

Furthermore, the connecting means 22 can be fixed on the winding tube 4 using a fastening element, for example a fastening screw or a rivet, not shown, following the positioning of the electromechanical actuator 11 inside the winding tube 4.

The electromechanical actuator 11 also comprises a closing off element 21 for one end of the case 17.

The closing off element 21 is positioned at one end of the case 17 of the tubular electromechanical actuator 11.

Here, the case 17 of the electromechanical actuator 11 is fastened to a support 23, in particular a flange, of the box 9 of the concealing device 3 using the closing off element 21 forming a torque pin, in particular a closing off and torque-reacting head. In such a case where the closing off element 21 forms a torque pin, the closing off element 21 is also called a fixed point of the electromechanical actuator 11.

Advantageously, the closing off element 21 of the electromechanical actuator 11 is a revolving part, in particular with a circular section.

The electronic control unit 15 of the electromechanical actuator 11 comprises a device for detecting obstacles and ends of travel during winding of the screen 2 and during unwinding of said screen 2.

The winding device 25 in particular comprises the winding tube 4, the electromechanical actuator 11 of the tubular type, a hollow sleeve 24 and two supports 23.

The winding tube 4, the tubular electromechanical actuator 11 and the hollow sleeve 24 are installed between the two supports 23, in the assembled configuration of the winding device 25.

Each support 23 is positioned across from an end 4*a*, 4*b* of the winding tube 4.

The hollow sleeve 24 is positioned at one 4*a* of the ends 4*a*, 4*b* of the winding tube 4 and inside the winding tube 4.

Here, the hollow sleeve 24 is positioned at the end 4*a* of the winding tube 4 at which the tubular electromechanical actuator 11 is inserted in the winding tube 4, during the assembly of the winding device 25.

The hollow sleeve 24 is situated between the inner surface of the winding tube 4 and the outer surface of the case 17 of the tubular electromechanical actuator 11 in the assembled configuration of the winding device 25.

The other end 4*b* of the winding tube 4 is functionally connected to a support 23, in particular a flange, of the box 9 of the concealing device 3 via a bearing 38, in this example embodiment having two ball bearings 39, 40, so as to allow the rotational movement of the winding tube 4 around the rotation axis X.

In practice, depending on the width of the opening 1, the bearing 38 may be further, along the rotation axis X, from the tubular electromechanical actuator 11 than what is shown in FIG. 3. This is represented by the two oblique lines in mixed dashes in FIG. 3.

Reference W denotes the length of the winding device 25, measured parallel to the rotation axis X, between the supports 23.

The hollow sleeve 24 has, on a part L1 of its length L measured parallel to the rotation axis X, an outer section corresponding to the inner section of the winding tube 4. "Corresponding" means that the outer section of the hollow sleeve 24 has a geometry similar to the inner section of the winding tube 4, while having a convex shape, while the inner section of the winding tube 4 has a concave shape.

The portion of the hollow sleeve 24 having an outer section corresponding to the inner section of the winding tube 4 is fully positioned inside the winding tube 4, over its entire length L1.

The tubular electromechanical actuator 11, in particular the case 17 thereof, is inserted inside the hollow sleeve 24.

Here, the hollow sleeve 24 is made in the form of a ring. The case 17 of the tubular electromechanical actuator 11 is inserted inside the hollow sleeve 24. Additionally, the hollow sleeve 24 is inserted in the winding tube 4.

Here, only part of the tubular electromechanical actuator 11 is positioned inside the hollow sleeve 24.

Preferably, the outer section of the hollow sleeve 24 and the inner section of the winding tube 4 have indentations 30, so as to secure the hollow sleeve 24 in rotation relative to the winding tube 4 around the rotation axis X.

Thus, the hollow sleeve 24 is blocked in rotation on the winding tube 4.

The indentations 30 of the outer section of the hollow sleeve 24 and the inner section of the winding tube 4 form slots and ribs, extending along the length of their respective bodies, in particular along the longitudinal axis, which is combined with the rotation axis X in the assembled configuration of the winding device 25.

In this way, the indentations 30 of the hollow sleeve 24 are configured to cooperate in translation with the indentations 30 of the winding tube 4, along the rotation axis X of the winding tube 4 in the assembled configuration of the winding device 25.

Preferably, at least one of the indentations 30 of the outer section of the hollow sleeve 24 is complementary with at least one of the indentations 30 of the inner section of the winding tube 4.

Thus, the rotational blocking of the hollow sleeve 24 relative to the winding tube 4 is done using respective indentations 30, so as to avoid rubbing of the hollow sleeve 24 on the winding tube 4.

In this way, the rotational blocking of the hollow sleeve 24 relative to the winding tube 4 makes it possible to avoid wear of the hollow sleeve 24 inserted inside the winding tube 4.

In one embodiment, the winding tube 4 is made from a bent metal sheet and the two ends of said sheet are connected by the formation of a bent joint. Additionally, the section of the winding tube 4 has a cannulated shape.

In the assembled configuration of the winding device 25, the closing off element 21 comprises a front face 21*a* positioned in a plane P parallel to a wall 34 of one of the two supports 23.

Here, the front face 21*a* of the closing off element 21 is orthogonal to the axis of the tubular electromechanical actuator 11, which is also the rotation axis X of the winding tube 4 in the assembled configuration of the motorized driving device 5. Additionally, the wall 34 of the support 23 is orthogonal to the rotation axis X of the winding tube 4 in the assembled configuration of the motorized driving device 5.

The closing off element 21 of the tubular electromechanical actuator 11 comprises fastening elements 42 cooperating with fastening elements 41 of the support 23.

Here and as illustrated in FIG. 3, the support 23 comprises a fastening tab 41 cooperating with a fastening slit 42 arranged in the closing off element 21 of the tubular electromechanical actuator 11, where the fastening tab 41 is forcibly fitted inside the slit 42 until reaching a stop.

Of course, the fastening elements of the closing off element 21 of the tubular electromechanical actuator 11 and the support 23 are in no way limiting and can in particular be fastening elements by elastic snapping, fitting or screwing.

Furthermore, the assembly of the closing off element 21 of the tubular electromechanical actuator 11 on the support 23 can be implemented by having the front face 21*a* of the closing off element 21 of the tubular electromechanical actuator 11 bear against the wall 34 of the support 23, or by the insertion of the closing off element 21 of the tubular electromechanical actuator 11 through an opening arranged in the wall 34 of the support 23.

Advantageously, the closing off element 21 of the tubular electromechanical actuator 11 comprises electrical connecting elements, not shown, so as to allow the supply of electricity and the control of the electric motor 16 of the tubular electromechanical actuator 11. These electrical connection elements in particular make it possible to connect the power cable 18 to the electronic control unit 15.

The hollow sleeve 24 comprises a first stop 26 cooperating with a stop 28 of the closing off element 21 of the tubular electromechanical actuator 11, so as to block the translation of the hollow sleeve 24 relative to the closing off element 21 of the tubular electromechanical actuator 11.

In practice, the first stop 26 is formed by an inner shoulder of the hollow sleeve 24. This shoulder is arranged in the portion of the hollow sleeve 24 that has an outer section corresponding to the inner section of the winding tube 4 and that is fully received inside the tube, over its entire length L1.

Furthermore, the hollow sleeve 24 comprises a second stop 27 cooperating with the end 4*a* of the winding tube 4 through which the hollow sleeve 24 is inserted in the winding tube 4, in an insertion direction of the hollow sleeve 24 inside the winding tube 4, so as to block the translation of the hollow sleeve 24 relative to the end 4*a* of the winding tube 4.

In practice, the second stop 27 of the hollow sleeve 24 is arranged at one of the ends of the hollow sleeve 24.

Thus, the second stop 27 of the hollow sleeve 24 makes it possible to guarantee positioning of the hollow sleeve 24 relative to the end 4*a* of the winding tube 4, in the direction of the rotation axis of the winding tube 4, which is combined with the rotation axis X in the assembled configuration of the winding device 25.

Furthermore, the second stop 27 of the hollow sleeve 24 makes it possible to prevent the hollow sleeve 24 from entering the winding tube 4 excessively, in particular during the insertion of the tubular electromechanical actuator 11 into the winding tube 4, in order to avoid pushing the hollow sleeve 24 into the winding tube 4 past the second stop 27 and the hollow sleeve 24 no longer being positioned around the case 17 of the electromechanical actuator 11, in the assembled configuration of the winding device 25, and to guarantee the maintenance in position of the tubular electromechanical actuator 11 inside the winding tube 4 relative to the hollow sleeve 24.

Advantageously, the hollow sleeve 24 has, at its second stop 27, an outer section larger than or equal to the outer section of the winding tube 4. "Greater than or equal to" means that the section of the second stop 27 extends, relative to the rotation axis X, at a radial distance greater than or equal to the maximum radial distance at which the outer surface of the winding tube 4 extends.

Here, the second stop 27 of the hollow sleeve 24 is made in the form of a collar, in particular with a cylindrical and planar shape.

Advantageously, only the part of the hollow sleeve 24 making up the second stop 27 is positioned outside the winding tube 4.

Thus, the hollow sleeve 24 is positioned practically completely inside the winding tube 4, so as to limit the mechanical forces between the winding tube 4 and the hollow sleeve 24 and minimize the costs of obtaining the latter.

Here, the first and second stop 26, 27 of the hollow sleeve 24 are formed by walls of the hollow sleeve 24.

Advantageously, the winding device 25 comprises fastening members cooperating with the hollow sleeve 24 and the winding tube 4, so as to block the translation of the hollow sleeve 24 relative to the winding tube 4.

In this way, the fastening elements make it possible to prevent axial sliding of the hollow sleeve 24 relative to the winding tube 4, so as to minimize the operating noise of the winding device 25.

Here, the hollow device 24 is fastened to the winding tube 4 by fastening elements at the end 4*a* of the winding tube 4 for receiving the tubular electromechanical actuator 11.

As one non-limiting example, the fastening elements of the winding tube 4 and the hollow sleeve 24 are fastening elements by screwing. In this case, the hollow sleeve 24 comprises at least one passage hole 36, in particular arranged in the collar forming the second stop 27 of the hollow sleeve 24, and the winding tube 4 comprises a screwing hole, in particular at the end 4*a* of the winding tube 4. A fastening screw, not shown, passes through each passage hole 36 of the hollow sleeve 24 and is screwed in the screwing hole of the winding tube 4.

Figure 7:
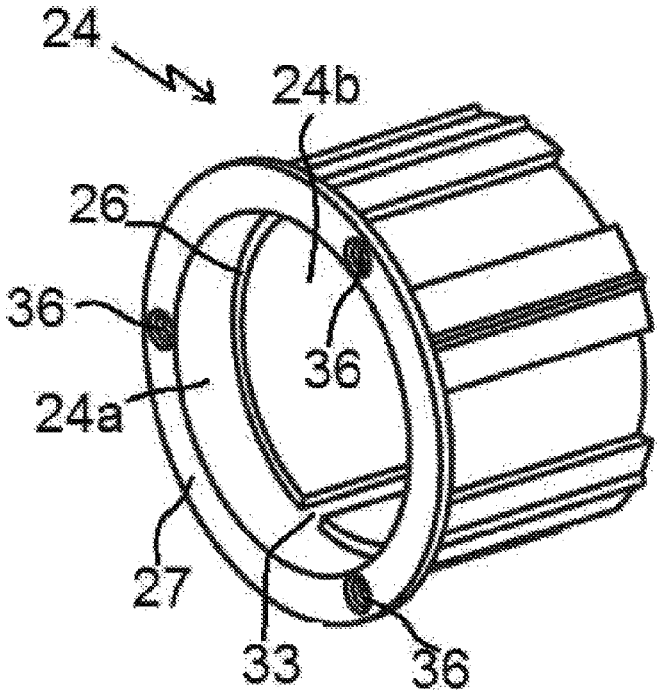
FIG. 7 is a diagrammatic perspective view of a hollow sleeve of the winding device illustrated in FIGS. 4 to 6.

Here and non-limitingly, the hollow sleeve 24 comprises three passage holes 36, as illustrated in FIG. 7.

Preferably, the hollow sleeve 24 is made from plastic.

As non-limiting examples, the plastic material of the hollow sleeve 24 may be polyoxymethylene, also called "POM", or acrylonitrile butadiene styrene, also called "ABS".

The hollow sleeve 24 and the winding tube 4 partially cover the closing off element 21 of the tubular electromechanical actuator 11, over an axial range PA that extends between the stop 28 of the closing off element 21 of the tubular electromechanical actuator 11 and the front face 21*a* of the closing off element 21. In other words, if one considers the axial range PA, which extends along the rotation axis X, between the stop 28 and the front face 21*a* of the closing off element 21, then the hollow sleeve 24 and the winding tube 4 cover part of this axial range PA, i.e., the grey zone Z in FIG. 5.

In an alternative that is not shown, the covering zone Z corresponds to the entire axial range PA.

The axial length of the zone Z is therefore smaller than or equal to that of the axial range PA.

Thus, the at least partial covering of the closing off element 21 of the tubular electromechanical actuator 11 by the hollow sleeve 24 and the winding tube 4 over the axial range PA, between the stop 28 of the closing off element 21 of the tubular electromechanical actuator 11 and the front face 21*a* of the closing off element 21, makes it possible to reduce the axial distance G between the support 23 of the winding device 25 on which the closing off element 21 of the tubular electromechanical actuator 11 is fastened and the end 4*a* of the winding tube 4 through which the tubular electromechanical actuator 11 is inserted. The axial distance G is measured parallel to the rotation axis X.

In this way, the second stop 27 of the hollow sleeve 24 and the end 4*a* of the winding tube 4 through which the tubular electromechanical actuator 11 is inserted protrude past the stop 28 of the closing off element 21 of the tubular electromechanical actuator 11 toward the adjacent support 23, along the direction of the rotation axis X of the winding tube 4.

The second stop 27 of the hollow sleeve 24 cooperating with the end 4*a* of the winding tube 4, through which the hollow sleeve 24 is inserted in the winding tube 4, is closer to the support 23 on which the closing off element 21 of the tubular electromechanical actuator 11 is fastened than the first stop 26 of the hollow sleeve 24 cooperating with the stop 28 of the closing off element 21 of the tubular electromechanical actuator 11, along the direction of the rotation axis of the hollow sleeve 24, which is combined, in the assembled configuration, with the rotation axis X of the winding tube 4.

Such an assembly makes it possible to limit the protrusion of the closing off element 21 of the tubular electromechanical actuator 11 relative to the end 4*a* of the winding tube 4.

Furthermore, the space between a lateral edge of the screen 2, which is adjacent to the closing off element 21, and the support 23 adjacent to the winding device 25 is minimized.

In this way, with the winding device 25 comprising such a hollow sleeve 24, the screen 2 can be wound around the winding tube 4 as close as possible to the support 23, so as to reduce the space between the lateral edge of the screen 2 and the support 23 of the winding device 25.

Reference B denotes the axial length of the sleeve 24 between its first and second stops 26 and 27. The determination of the axial length B makes it possible to adjust the positioning of the end 4*a* of the winding tube 4, through which the hollow sleeve 24 is inserted in the winding tube 4, relative to the front face 21*a* of the closing off element 21 of the tubular electromechanical actuator 11, along the rotation axis X of the winding tube 4 around the tubular electromechanical actuator 11.

In this way, the choice of the axial length B between the first and second stops 26, 27 can be made by the sizing of the hollow sleeve 24.

Furthermore, the sizing of the axial length B between the first and second stops 26, 27 of the hollow sleeve 24 makes it possible to adjust the axial distance G between the support 23 of the winding device 25 on which the closing off element 21 of the tubular electromechanical actuator 11 is fastened and the end 4*a* of the winding tube 4 through which the tubular electromechanical actuator 11 is inserted.

Advantageously, such an assembly of the tubular electromechanical actuator 11, the hollow sleeve 24 and the winding tube 4 on the support 23 of the winding device 25 can be implemented with a closing off element 21 of the standard tubular electromechanical actuator 11 and a standard winding tube 4.

In this way, the tubular electromechanical actuator 11 or the winding tube 4 used in the winding device 25 according to the invention may also be used in another winding device with no hollow sleeve 24.

Here, the closing off element 21 of the tubular electromechanical actuator 11 may have different shapes, in particular a circular or star shape.

In practice, the hollow sleeve 24 has a first part 24*a* at least partially covering the closing off element 21 of the tubular electromechanical actuator 11 and having a first thickness e1, as well as a second part 24*b* partially covering the case 17 of the tubular electromechanical actuator 11 and having a second thickness e2, where the first thickness e1 of the first part 24*a* of the hollow sleeve 24 is smaller than the second thickness e2 of the second part 24*b* of the hollow sleeve 24.

Thus, the reduction in the thickness of the hollow sleeve 24 at the covering zone of the closing off element 21 of the tubular electromechanical actuator 11 makes it possible to maintain a constant outer diameter of the entire length of the body of the hollow sleeve 24, or in other words over the length of the first and second parts 24*a*, 24*b* of the hollow sleeve 24, which corresponds to the portion of the length L1 with an outer section corresponding to the inner section of the winding tube 4 and that is completely received inside that tube.

Furthermore, the reduction in the thickness of the hollow sleeve 24 at the covering zone of the closing off element 21 of the tubular electromechanical actuator 11 makes it possible to minimize the outer diameter of the hollow sleeve 24 and, consequently, the inner diameter of the winding tube 4, since the winding tube 4 completely covers the body of the hollow sleeve 24, and in particular, up to the second stop 27 of the hollow sleeve 24.

Furthermore, the change in thickness between the first and second parts 24*a*, 24*b* of the hollow sleeve 24 makes it possible to define the first stop 26 of the hollow sleeve 24.

Preferably, the winding device 25 also comprises a ring 29 positioned between the tubular electromechanical actuator 11 and the hollow sleeve 24. The tubular electromechanical actuator 11 is inserted inside the ring 29.

Thus, the hollow sleeve 24 is situated between the inner surface of the winding tube 4 and the outer surface of the ring 29.

The case 17 of the tubular electromechanical actuator 11 has, on at least part D1 of its length D measured parallel to the rotation axis X, an outer section corresponding to the inner section of the ring 29. "Corresponding" means that the outer section of the case 17 of the tubular electromechanical actuator 11 has a geometry similar to the inner section of the ring 29, while having a convex shape, while the inner section of the winding tube 4 has a concave shape.

The outer section of the case 17 of the tubular electromechanical actuator 11 and the inner section of the ring 29 are circular.

Furthermore, in the example of FIGS. 3 to 6, the length D1 is equal to the total length D of the case 17 of the tubular electromechanical actuator 11.

The ring 29 has, over at least part T1 of its length T measured parallel to the rotation axis X, an outer section corresponding to the inner section of the hollow sleeve 24. "Corresponding" means that the outer section of the ring 29 has a geometry similar to the inner section of the hollow sleeve 24, while having a convex shape, whereas the inner section of the hollow sleeve 24 has a concave shape.

The outer section of the ring 29 and the inner section of the hollow sleeve 24 are circular.

Here, the first stop 26 of the hollow sleeve 24 cooperates with the stop 28 of the closing off member 21 of the tubular electromechanical actuator 11, so as to block the translation of the hollow sleeve 24 relative to the closing off element 21 of the tubular electromechanical actuator 11.

Preferably, the outer diameter O of the part of the closing off element 21 of the tubular electromechanical actuator 11 situated outside the case 17 of the tubular electromechanical actuator 11, in the assembled configuration of the tubular electromechanical actuator 11, is greater than or equal to the outer diameter S of the case 17 of the tubular electromechanical actuator 11.

Thus, the closing off element 21 of the tubular electromechanical actuator 11 used in such a winding device 25 can be standard and can be used with the hollow sleeve 24 in the present case or with a known hollow sleeve.

Figure 6:
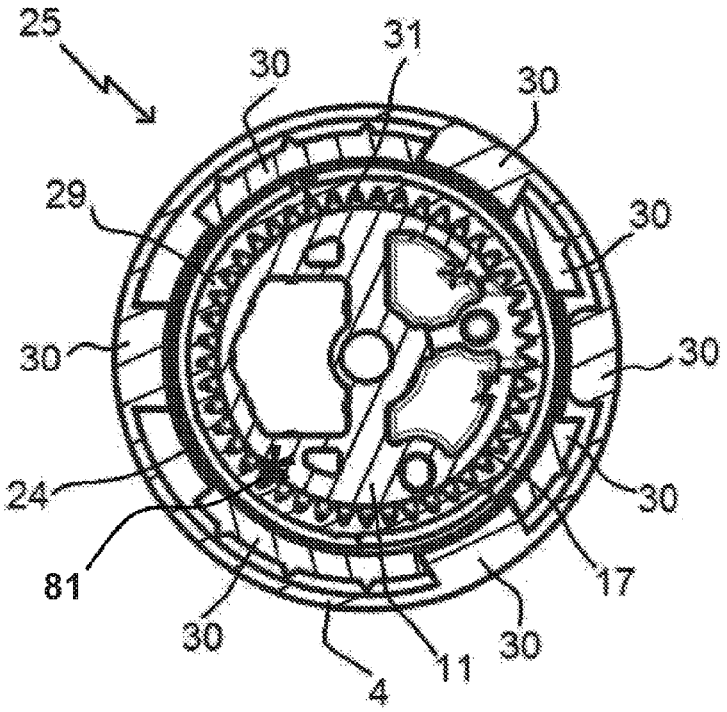
FIG. 6 is a radial sectional diagrammatic view of the winding device illustrated in FIGS. 4 and 5.

As shown only in FIG. 6, the ring 29 advantageously comprises, on its inner face, a gear 31 in the form of a crown cooperating with a pinion 81 of a metering mechanism, not further shown, installed inside the case 17 of the tubular electromechanical actuator 11.

Thus, the ring 29 rotates the pinion of the metering mechanism installed inside the case 17 of the tubular electromechanical actuator 11, so as to count the number of rotations of the winding tube 4, to determine the rotation direction of the winding tube 4 and manage the end-of-travel positions of the screen 2.

In practice, the ring 29 also comprises a rib 32, such as a key, and the hollow sleeve 24 comprises a groove 33, where the rib 32 of the ring 29 cooperates with the groove 33 of the hollow sleeve 24, so as to secure the ring 29 in rotation relative to the hollow sleeve 24.

Thus, the ring 29 is blocked in rotation on the hollow sleeve 24.

Here, the rib 32 of the ring 29 is arranged on the outer surface of the body of the ring 29. Additionally, the groove 33 of the hollow sleeve 24 is arranged on the inner surface of the body of the hollow sleeve 24.

The rib 32 of the ring 29 and the groove 33 of the hollow sleeve 24 extend along the length of their respective bodies, in particular along their longitudinal axis, which is parallel to the rotation axis X in the assembled configuration of the winding device 25.

In this way, the rib 32 of the ring 29 is configured to cooperate in translation with the groove 33 of the hollow sleeve 24, along the rotation axis X in the assembled configuration of the winding device 25.

In another embodiment, the ring 29 is smooth and forms a bearing. In this case, the ring 29 rotates freely around the case 17 of the tubular electromechanical actuator 11.

Advantageously, the ring 29 comprises a stop 35. A first face 35*a* of the stop 35 of the ring 29 is placed bearing against the stop 28 of the closing off element 21 of the tubular electromechanical actuator 11. Additionally, the first stop 26 of the hollow sleeve 24 is placed bearing against a second face 35*b* of the stop 35 of the ring 29.

Thus, the stop 35 of the ring 29 is placed between the stop 28 of the closing off member 21 of the tubular electromechanical actuator 11 and the first stop 26 of the hollow sleeve 24.

In this way, the ring 29 is blocked in translation, along the direction of the rotation axis X of the winding tube 4, which is combined with the rotation axis in the assembled configuration of the winding device 25, relative to the closing off element 21 of the tubular electromechanical actuator 11. Additionally, the hollow sleeve 24 is blocked in translation, along the direction of the rotation axis X of the winding tube 4, which is combined with the rotation axis in the assembled configuration of the winding device 25, relative to the ring 29.

In a first case, not shown, the hollow sleeve 24 comprises adjusting elements, not shown, so as to adjust the axial length B between the first and second stops 26, 27 of the hollow sleeve 24 and adjust the position of the end 4*a* of the winding tube 4, through which the hollow sleeve 24 is inserted in the winding tube 4, relative to the front face 21*a* of the closing off element 21 of the tubular electromechanical actuator 11, along the rotation axis X of the winding tube 4 around the tubular electromechanical actuator 11.

Thus, the adjustment of the position of the end 4*a* of the winding tube 4 through which the hollow sleeve 24 is inserted in the winding tube 4 relative to the front face 21*a* of the closing off element 21 of the tubular electromechanical actuator 11 is done on the same side of the winding tube 4 as the fastening of the tubular electromechanical actuator 11 on the support 23 and the electrical connection of the power cable 18 to the electronic control unit 15 of the tubular electromechanical actuator 11.

Furthermore, the adjustment of the axial length B between the first and second stops 26, 27 of the hollow sleeve 24 makes it possible to adjust the axial distance G between the support 23 of the winding device 25 on which the closing off element 21 of the tubular electromechanical actuator 11 is fastened and the end 4*a* of the winding tube 4 through which the tubular electromechanical actuator 11 is inserted.

The adjusting elements of the hollow sleeve 24 make it possible to adjust the covering zone of the closing off element 21 of the tubular electromechanical actuator 11 by the hollow sleeve 24 and the winding tube 4.

Consequently, the adjustment of the axial length B between the first and second stops 26, 27 of the hollow sleeve 24 makes it possible to adjust the space between each lateral edge of the screen 2 and the respective adjacent support 23 of the winding device 25.

In this way, the screen 2 wound on the winding tube 4 can be centered relative to the two supports 23, so as to adjust the space between each lateral edge of the screen 2 and one of the two supports 23.

The adjustment of the axial length B between the first and second stops 26, 27 of the hollow sleeve 24 is implemented during the installation of the winding device 25 in the closure or sun-protection home-automation installation.

In one example embodiment, the adjusting elements of the hollow sleeve 24 are sectile elements.

Figure 8:
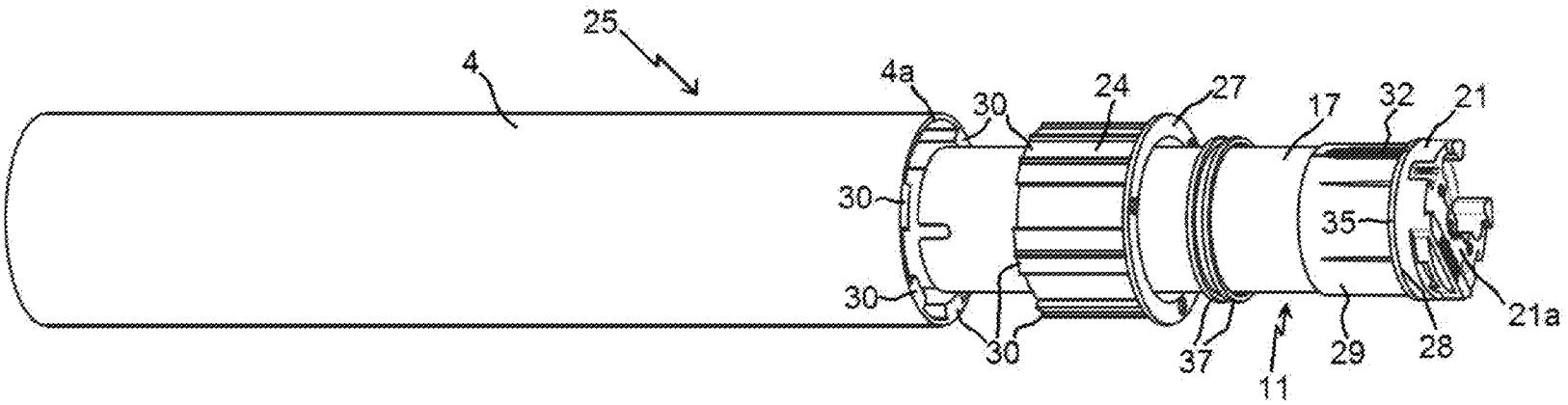
FIG. 8 is a diagrammatic view similar to FIG. 4 for a second embodiment of the invention where the winding device comprises adjusting elements.

In a second case, as illustrated in FIG. 8, the winding device 25 comprises adjusting elements 37, so as to adjust the positioning of the end 4*a* of the winding tube 4, through which the hollow sleeve 24 is inserted in the winding tube 4, relative to the front face 21*a* of the closing off element 21 of the tubular electromechanical actuator 11, along the rotation axis X of the winding tube 4 around the tubular electromechanical actuator 11.

Thus, the adjustment of the position of the end 4*a* of the winding tube 4 through which the hollow sleeve 24 is inserted in the winding tube 4 relative to the front face 21*a* of the closing off element 21 of the tubular electromechanical actuator 11 is done on the same side of the winding tube 4 as the fastening of the tubular electromechanical actuator 11 on the support 23 and the electrical connection of the power cable 18 to the electronic control unit 15 of the tubular electromechanical actuator 11.

Furthermore, such an adjustment makes it possible to adjust the axial distance G between the support 23 of the winding device 25 on which the closing off element 21 of the tubular electromechanical actuator 11 is fastened and the end 4*a* of the winding tube 4 through which the tubular electromechanical actuator 11 is inserted.

The adjusting elements 37 of the winding device 25 make it possible to adjust the covering zone of the closing off element 21 of the tubular electromechanical actuator 11 by the hollow sleeve 24 and the winding tube 4.

Consequently, the adjustment of the position of the end 4*a* of the winding tube 4 through which the hollow sleeve 24 is inserted in the winding tube 4 relative to the front face 21*a* of the closing off element 21 of the tubular electromechanical actuator 11 makes it possible to adjust the space between each lateral edge of the screen 2 and the respective adjacent support 23 of the winding device 25.

In this way, the screen 2 wound on the winding tube 4 can be centered relative to the two supports 23, so as to adjust the space between each lateral edge of the screen 2 and one of the two supports 23.

The adjustment of the position of the end 4*a* of the winding tube 4 through which the hollow sleeve 24 is inserted in the winding tube 4 relative to the front face 21*a* of the closing off element 21 of the tubular electromechanical actuator 11 is implemented during the installation of the winding device 25 in the closure or sun-protection home-automation installation.

In practice, the adjusting elements 37 of the winding device 25, which can in particular be washers mounted around the case 17 of the tubular electromechanical actuator 11 as shown in FIG. 8, are positioned between the first stop 26 of the hollow sleeve 24 and the stop 28 of the closing off element 21 of the tubular electromechanical actuator 11.

In the embodiment illustrated in FIG. 8, where the winding device 25 comprises the ring 29, the adjusting elements 37 of the winding device 25 are placed against the first stop 26 of the hollow sleeve 24 and against a face, in particular the second face 35*b*, of the stop 35 of the ring 29.

In one embodiment, the adjustment of the position of the end 4*a* of the winding tube 4 through which the hollow sleeve 24 is inserted in the winding tube 4 relative to the front face 21*a* of the closing off element 21 of the tubular electromechanical actuator 11 can be implemented via adjusting elements of the hollow sleeve 24, as previously described in the first case, and via adjusting elements 37 of the winding device 25, as previously described in the second case.

Owing to the present invention, the at least partial covering of the closing off element of the tubular electromechanical actuator by the hollow sleeve and the winding tube, between the stop of the closing off element of the tubular electromechanical actuator and the front face of the closing off element, makes it possible to reduce the axial distance between the support of the winding device on which the closing off element of the tubular electromechanical actuator is fixed and the end of the winding tube through which the tubular electromechanical actuator is inserted.

The present invention also makes it possible to minimize the space between at least one lateral edge of the screen and the adjacent support of the winding device.

Many changes can be made to the example embodiment previously described without going beyond the scope of the invention defined by the claims.

Furthermore, the considered embodiments and alternatives may be combined to generate new embodiments of the invention.

The invention claimed is:

1. A winding device for a windable screen of a closure or sun-protection home-automation installation, the winding device comprising:

a winding tube movable around a rotation axis, a hollow sleeve, a tubular electromechanical actuator, and two supports, each support being positioned across from one of two ends of the winding tube, the tubular electromechanical actuator being inserted inside the hollow sleeve, the hollow sleeve being positioned at one of the two ends of the winding tube and inside the winding tube, the tubular electromechanical actuator comprising:

a case, and a closing off element, the closing off element being positioned at one end of the case of the tubular electromechanical actuator, the closing off element comprising a front face positioned in a plane parallel to a wall of one of the two supports, the closing off element of the tubular electromechanical actuator comprising first fastening elements cooperating with second fastening elements of said support, the hollow sleeve comprising:

a first stop cooperating with a stop of the closing off element of the tubular electromechanical element, so as to block the translation of the hollow sleeve relative to the closing off element of the tubular electromechanical actuator, and a second stop cooperating with the one end of the winding tube through which the hollow sleeve is inserted in the winding tube, in an insertion direction of the hollow sleeve inside the winding tube, so as to block the translation of the hollow tube relative to the end of the winding tube, wherein the hollow sleeve and the winding tube at least partially cover the closing off element of the tubular electromechanical actuator, over an axial range extending between the stop of the closing off element of the tubular electromechanical actuator and the front face of the closing off element, wherein the winding device comprises adjusting elements, for adjusting the positioning of the one end of the winding tube, through which the hollow sleeve is inserted in the winding tube, relative to the front face of the closing off element of the tubular electromechanical actuator, along a rotation axis of the winding tube around the tubular electromechanical actuator, and wherein the adjusting elements of the device are positioned between the first stop of the hollow sleeve and the stop of the closing off element of the tubular electromechanical actuator.

2. The winding device for a windable screen of a closure or sun-protection home-automation installation according to claim 1, wherein the winding device also comprises a ring positioned inside the hollow sleeve, wherein the tubular is inserted inside the ring with the ring located radially between the tubular electromechanical actuator and the hollow sleeve.

3. The winding device for a windable screen of a closure or sun-protection home-automation installation according to claim 2, wherein the ring comprises, on its inner face, a gear cooperating with a pinion of a metering mechanism installed inside the case of the tubular electromechanical actuator.

4. The winding device for a windable screen of a closure or sun-protection home-automation installation according to claim 2, wherein the ring is smooth and forms a bearing.

5. The winding device for a windable screen of a closure or sun-protection home-automation installation according to claim 1, wherein the hollow sleeve comprises adjusting elements, for adjusting the axial length between the first stop and the second stop of the hollow sleeve and for adjusting the positioning of the one end of the winding tube, through which the hollow sleeve is inserted in the winding tube, relative to the front face of the closing off element of the tubular electromechanical actuator, along a rotation axis of the winding tube around the tubular electromechanical actuator.

6. The winding device for a windable screen of a closure or sun-protection home-automation installation according to claim 5, wherein the adjusting elements of the hollow sleeve are sectile elements.

7. The winding device for a windable screen of a closure or sun-protection home-automation installation according to claim 1, wherein the closing off element of the tubular electromechanical actuator is a part of revolution, and wherein the tubular electromechanical actuator has a circular section.

8. The winding device for a windable screen of a closure or sun-protection home-automation installation according to claim 1, wherein the outer diameter of a portion of the closing off element of the tubular electromechanical actuator situated outside the case of the tubular electromechanical actuator, in an assembled configuration of the tubular electromechanical actuator, is greater than or equal to the outer diameter of the case of the tubular electromechanical actuator.

* * * * *